US006454221B1

(12) United States Patent
Bonfigli

(10) Patent No.: US 6,454,221 B1
(45) Date of Patent: Sep. 24, 2002

(54) SWITCH BOX FOR RAILWAY, TRAMWAY POINTS, OR SIMILAR

(75) Inventor: Giuseppe Bonfigli, Bologna (IT)

(73) Assignee: Alstom Transport S.p.A., Bologna (IT)

( * ) Notice: Subject to any disclaimer, the term of this patent is extended or adjusted under 35 U.S.C. 154(b) by 0 days.

(21) Appl. No.: 09/529,798

(22) PCT Filed: Oct. 19, 1998

(86) PCT No.: PCT/EP98/06598

§ 371 (c)(1),
(2), (4) Date: May 18, 2000

(87) PCT Pub. No.: WO99/20513

PCT Pub. Date: Apr. 29, 1999

(30) Foreign Application Priority Data

Oct. 22, 1997 (IT) ..... SV97A0044

(51) Int. Cl.[7] ..... E01B 7/02

(52) U.S. Cl. ..... 246/415 R; 246/393; 246/450

(58) Field of Search ..... 246/476, 415 R, 246/430, 448, 449, 450, 451, 454, 220, 326, 393

(56) References Cited

U.S. PATENT DOCUMENTS 1,802,875 A * 4/1931 Conley ..... 246/221
4,921,189 A * 5/1990 Callegari ..... 246/344
5,116,006 A * 5/1992 Ocampo ..... 246/162
5,620,156 A * 4/1997 Berggren et al. ..... 246/221
5,893,289 A * 4/1999 Yeomans et al. ..... 72/431

FOREIGN PATENT DOCUMENTS

EP 480303 A2 * 10/1990 ..... B61L/5/04
EP 0480303 A2 * 4/1992
EP WO-9427853 A1 * 12/1994

* cited by examiner

*Primary Examiner*—S. Joseph Morano
*Assistant Examiner*—Frantz F. Jules
(74) *Attorney, Agent, or Firm*—James Creighton Wray; Meera P. Narasimhan

(57) ABSTRACT

Switch box for railway, tramway, or similar comprising a drive unit (M, 3, 4, 5, 5', 5'', 5''', 6) for the shifting motion of the blades (A1, A1', A2, A2') and at least one group of linear transmission (12, 20, 21, 24) of the drive motion to the blades, movable device (24, 124) to lock the blades in their respective closed positions. The groups are housed in a box (1) which has substantially the dimensions and the shape of a sleeper and which is fitted in the track in place of and with the function of a sleeper. The switch box has movable device (23, 24, 124) to lock the blades (A1, A1', A2, A2') in their corresponding closed positions. The device (23, 24, 124) are associated with their respective blade (A1, A2) and arranged inside the box (1) in the area of the same and are brought automatically into active locking position when the corresponding blade (A1, A2') reached the closed position, while they are automatically disengaged on activation of the switch box to switch the blade into the position of closure of the blade (A2', A1) opposite.

42 Claims, 11 Drawing Sheets

A1
A1'
B1
B1'
1
18
19
21
22
23
24
120
121
124
220
221
224
320
321
324
518

B1, B1', B2, B2'
2
102
101
1
30
240
140
39
41
38
51
35
38'
240
140
36
518
120
618
518

SWITCH BOX FOR RAILWAY, TRAMWAY POINTS, OR SIMILAR

BACKGROUND OF THE INVENTION

The invention relates to a switch box for railway, tramway points, or similar, comprising a group operating the motion of translation of the blades of the switch, and at least one group of linear transmission of the operating motion of the blades, movable means locking the blades in their respective positions of closure, said groups being housed in a box which has substantially the dimensions and the shape of a sleeper and which is fitted in the track in place of and with the function of a sleeper.

At present switch boxes of this type are known.

From WO 94/27853 a switch box of this type is known in which, however, only the operating groups the groups of linear transmission of the operating motion and the groups locking the blades in the closed positions are located inside the box. At a central slide, housed in the box branch out drive rods to operate the blades which are external to the same. The group locking the blades in the closed position acts on the very slide and not on the blades, while no means are provided allowing kicking of the blades, that is, the disengagement of the same from the locking means, under the action of a preset force which operates on the blades in direction of displacement of the same.

A further switch box of the type described at the beginning is known from the U.S. Pat. No. 4,093,163. In this case, also the link rods to the blades are housed in the box in shape of a sleeper, while neither means of lockswitching, nor means of kicking are provided.

SUMMARY OF THE INVENTION

The invention has the purpose to realize a switch box for railway, tramway points, or similar, of the type described at the beginning, in such a way, whereby means are provided in the same suitable to guarantee all of the functions of locking, lockswitching and or kicking of the usual switch boxes all the elements being mobile, with the exception of the blades integrated inside the box shaped like a sleeper, and the same being realized with an extremely simple construction, of reduced dimensions and such to ensure the housing in the defined available volume, as well as of safe and sure operation.

In particular, the invention aims at the realization of a switch box in which movable means of locking the blades in the corresponding position of closure are provided both by the linear transmission unit of the operating motion, as well as directly by the actual blades, all to reach the maximum operational surety and safety of the switch box.

The invention has also the further purpose to realize a switch box of the type described at the beginning that can be used with few modifications also with the so-called english type points.

The invention attains the above mentioned aims with a switch box of the type described at the beginning, in which are provided movable means for locking the blades in the corresponding closed position which are associated with the respective blade and arranged within the box in the area of the same blade and which are brought automatically into the active locking position when the corresponding blade reaches the position of closure, while they are automatically disengaged at the closed position of the opposite blade at the moment the switch box is activated to operate the blade.

The switch box, has means of linear transmission, formed by a saddle, slide or similar which are moved transversally to the track, particularly orthogonally to the same, in the two directions between the two extreme end of stroke positions by a group translating 10 the rotary motion into a linear motion and to which are linked a transmission rod for each of the two blades, while each blade is connected to a lever coupling it to the respective transmisssion rod thanks to corresponding movable means locking the blade in the closed position.

In particular, the coupling levers of the blades corresponding to the transmission rods form said movable locking means of the blades.

In a preferred form of execution, the said levers are oscillating and have a lateral tooth at the extremity opposite to the one of the fulcrum, each lever being coupled with the corresponding blade by a joint which allows the rotation of the oscillating lever around a perpendicular axis, preferably by means of a ball joint or similar, while the lever cooperates with fixed stops of engagement in the area of the blades there being provided between each coupling lever and the corresponding transmission rod means of control of the angular position of the same lever such, that, during the activation of the switch, the coupling levers are brought into position of disengagement by the stationary stops of engagement, before the transfer of the blades takes place and when the position of closure of one of the two blades is reached, the corresponding coupling lever is moved angularly into position of engagement of the tooth of the extremitity behind the corresponding stationary stop with reference to the direction of transfer of the closed blade to the position moving away from the associated rail.

Advantageously, the control means are formed by shaped slots or grooves which form control tracks with which at least one appendix protruding from the facing side of the coupling levers engages.

The axis of oscillation of the levers is foreseen in the area of the locking means to the corresponding blade, while the coupling lever extends itself beyond the blade in direction of the associated rail.

According to a further feature, the coupling levers are moved alternatively from the position of engagement with the stationary stops to the position of disengagement, thanks to a relative motion of the transmission rods with regards to the same in particular in an initial or terminal section of the stroke of operation.

A particularly advantageous form of construction consists of transmission rods with an angled groove in which at least one control pin of the corresponding coupling engages in motion, in combination with a pair of lateral guide walls of the free end section of transmission rods associated with the coupling levers. The angled slot or groove has a section parallel to the mean longitudinal axis of the transmission rods and which is arranged offset laterally beside said mean longitudinal axis, while said section extends itself towards the free extremity of the transmission rods with an inclined section which terminates substantially in the area of the mean longitudinal axis of the transmission rods or, in any case in an intermediate area of the transversal dimension of said rods. The position of the slot and its conformation, as well as the projection of the tooth of the angled levers is dimensioned and fitted in such a way, that in the initial section of the driving stroke, the transmission rods move relativley to the coupling levers as long as the lever in the engaged position which is associated with the blade closed in the start position is brought in position of disengagement from the stop, while the lever in position of disengagement associated with the blade which has to be brought into the position of closure moves from a substantially intermediate position between the two lateral guide walls into the position where it stops with the head of the tooth against the facing lateral guide wall, while the pins protruding from said coupling levers in the area of the tooth and engaged in the angled grooves, position themselves in an intermediate position of the inclined section of said grooves or slots, whereby, the inclinded wall turned in direction of motion of the blades, of each slott becomes, thanks to the limitation of the oscillation of the transmission lever associated with the blade which has to be brought to the position of closure by the lateral guides, the stop surface for driving the corresponding coupling lever together with the rod, while, as soon as the tooth comes out of the lateral guide the lever is free to oscillate further coming to a position of engagement with the front edge of the lateral guide. As a matter of fact, as soon as, the lateral guide wall or walls can no longer limit the oscillation of the coupling levers, the tie that allows the transmission rod to drive the coupling lever is automatically undone.

Advantageously, each transmission rod has a second slot substantially parallel and coincident with the mean longitudinal axis of the transmission rods and in which a pin or similar is seated which is movable along the rectilinear slot or groove and which with regards to the angular motion of the coupling lever is coaxial to the coupling means of the lever of the blade, for instance to a joint at least of the ball type.

According to a further feature of the invention, the transmission rods are carried by a common saddle supported in translatable manner in orthogonal direction to the axis of the track, the said saddle is connected to a drive slide by means of movable coupling means which pass to a position of disengagement of the rod-carrying saddle from the drive slide when the resistance to the translation of the blades and therefore of the rod-carrying slide exceeds a certain preset torque, or when a force is applied in the direction of translation directly on the blades.

In particular the rod-carrying saddle is provided with sliding rollers in a guide integral with the drive slide, the said rollers are supported spring mounted displaceable transversally to their axis, while each roller engages with an inclined plane provided in the rolling walls of the guide for the rod-carrying saddle, two inclined planes being provided, transversal to the sliding direction of the rod-carrying saddle and with inclinations simmetrically opposite each other for each rolling surface, each of these inclined planes is associated with a roller of the rod-carrying saddle.

Advantageously, the rod-carrying saddle is fitted in a upper guide integral with the drive slide orthogonally translatable to the axis of the track, two projections in shape of an isosceles trapezoid which are facing and coincident with each other are provided in the two opposite vertical lateral walls of the guide for the rod-carrying saddle., while the rod-carrying saddle is formed by two carriage springs fixed to each other, with the interposition of the transmission rod, in correspondence with the extrados sides and foreseen at the free section of the rollers revolving around vertical axis, the length of the carriage springs being such, that in the condition of engagement of the rod-carrying saddle and the drive slide, the vertical rollers are provided at the outermost extremity of the corresponding inclined plane in the area of connection to the vertical lateral wall of the guide.

In combination with the above, the invention furthermore foresees movable locking means of the the drive slide in the two end of stroke positions of closure of the one or the other blade.

Said means have advantageously rocker type means of control of disengagement and which are associated with the coupling means of the drive slide to a linear drive actuator, an initial relative stroke of said coupling means of the slide to linear actuator is provided before the mechanical coupling between the two said parts is made, during the said stroke the locking means of the drive slide are brought into condition of disengagement of the same slide.

The invention also relates to a switch box described at the beginning for an english type points, in which the means of locking the blades in position of closure, are only associated with the outermost blades of the four blades provided, while each of the two internal blades is locked in position of closure thanks to a rigid mechanical connection with the external blade which assumes the closed position of the same together with the internal blades.

The invention presents further features and perfectionings which are the subject of the claims below.

The features of the invention and the advantages derived from the same are better prooven by the Is following description of an executive example illustrated as non-limiting claim in the enclosed drawing in where:

BRIEF DESCRIPTION OF THE DRAWINGS

The FIG. 1 shows a plan view of a so-called english type point with a switch box according to the invention.

The FIG. 2 shows a cross-section according to a vertical plane transversal to the track of a switch box according to the FIG. 1.

Figure 1:
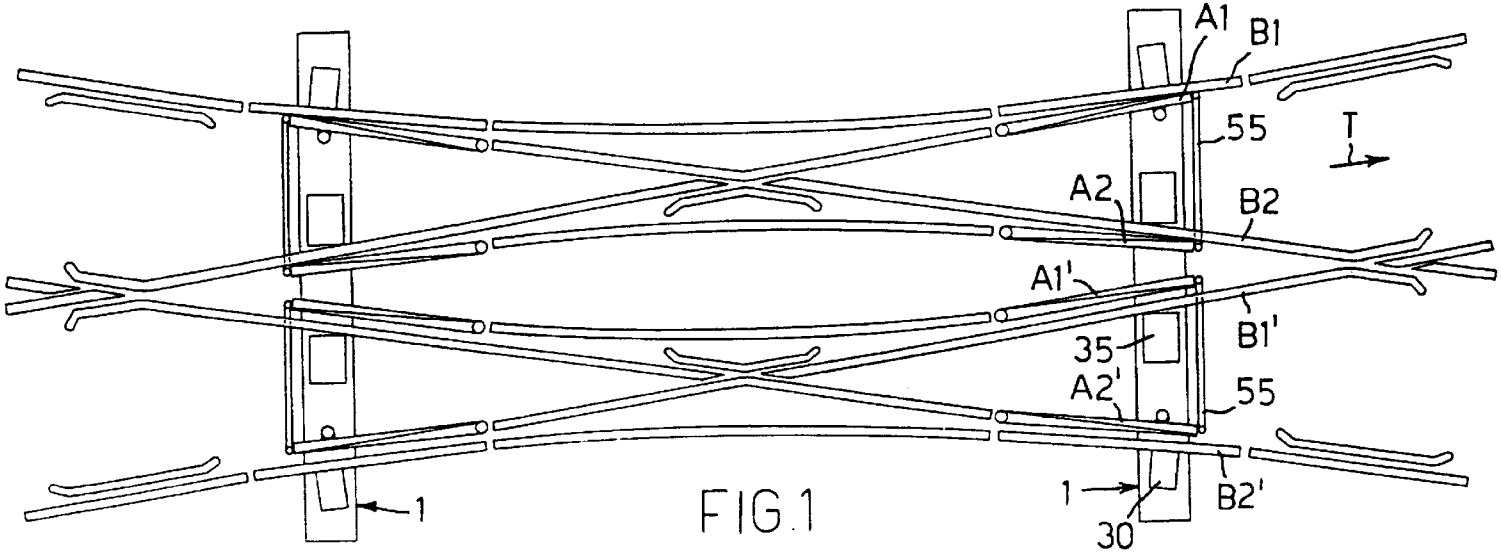
Figure 3:
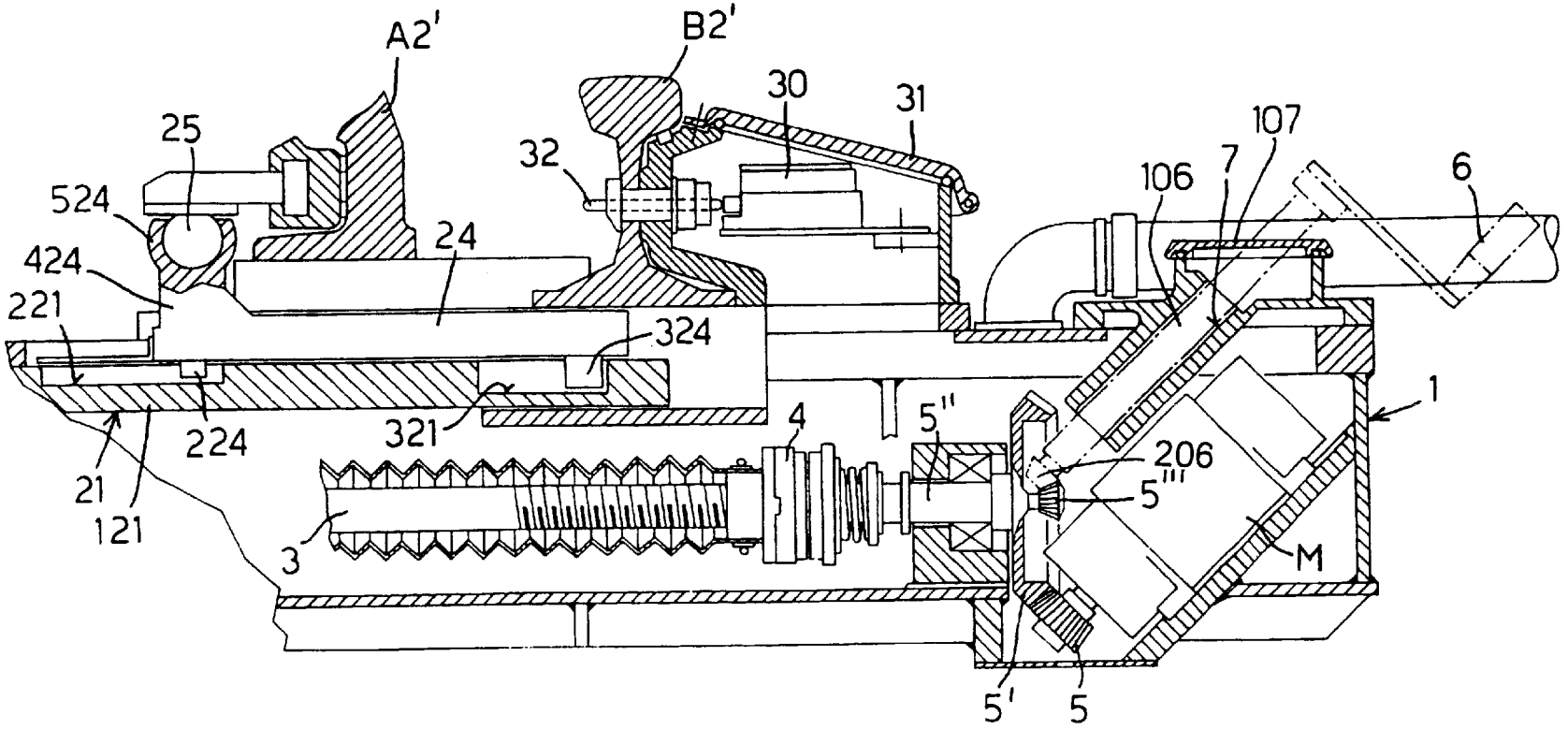

The FIG. 3 shows an enlarged detail of the cross-section according to the vertical plane of FIG. 1, in the area of one blade and one rail.

Figure 4:
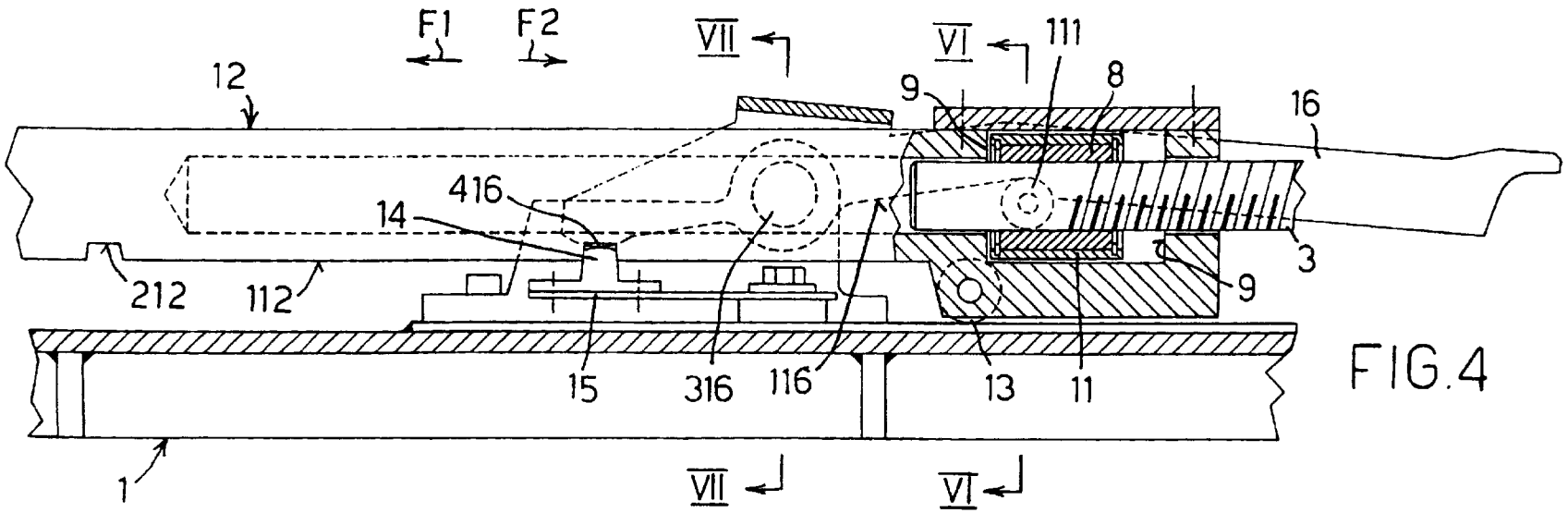
Figure 5:
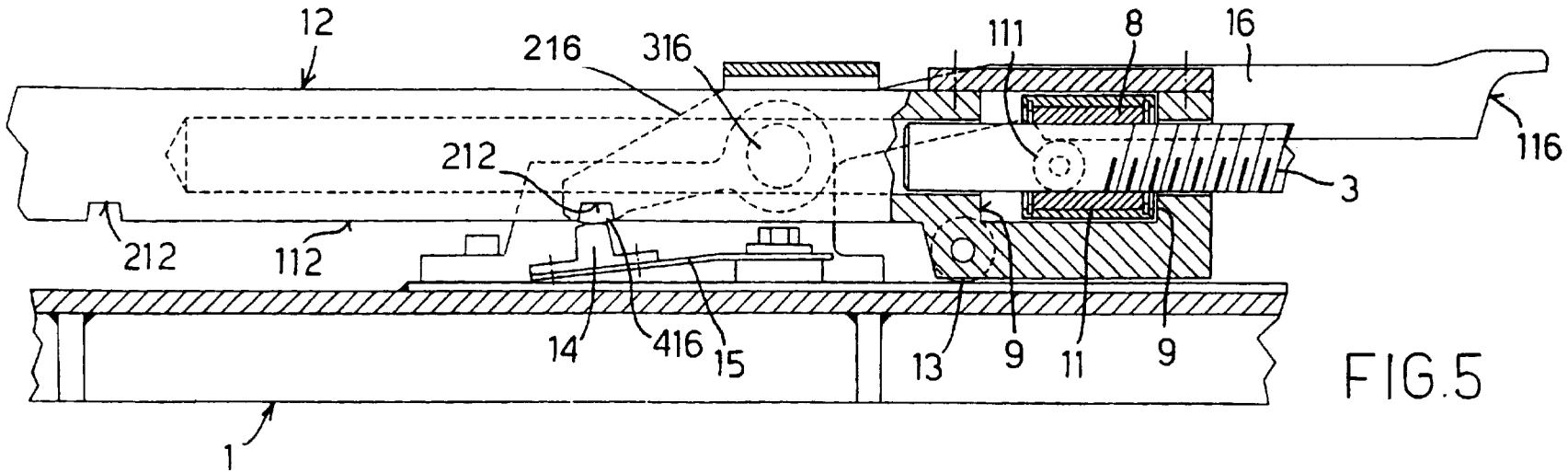

The FIGS. 4 and 5 show a detail relating to the drive slide and to the movable locking means of the same, in the locked and unlocked position respectively before the start of the translation.

Figure 7:
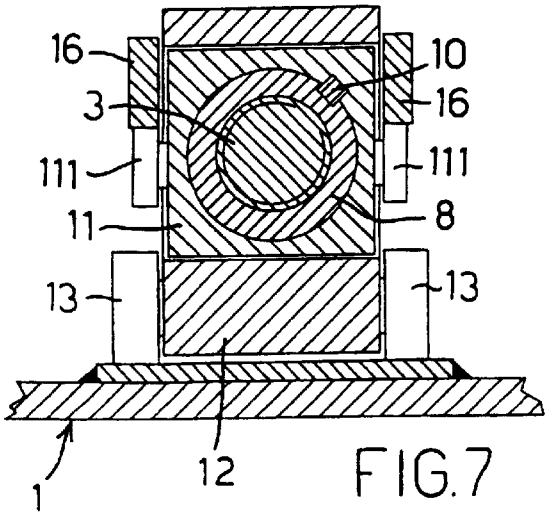
Figure 6:
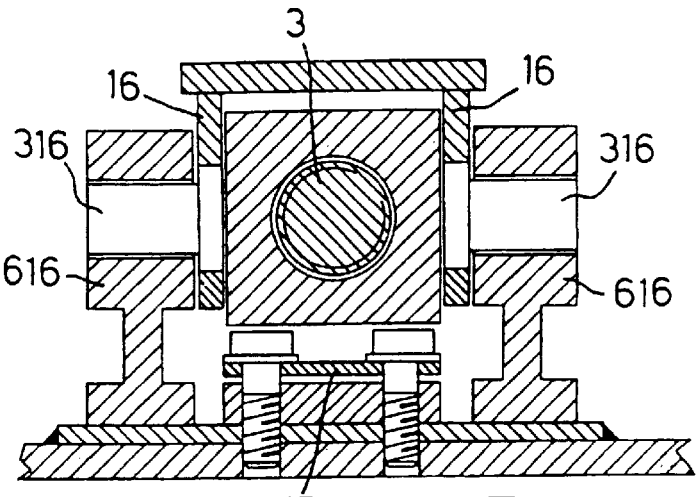

The FIGS. 6 and 7 show two transversal cross-sections of the saddle and of the movable locking means according to FIG. 4, according to the line VI—VI and VII—VII respectively.

Figure 8:
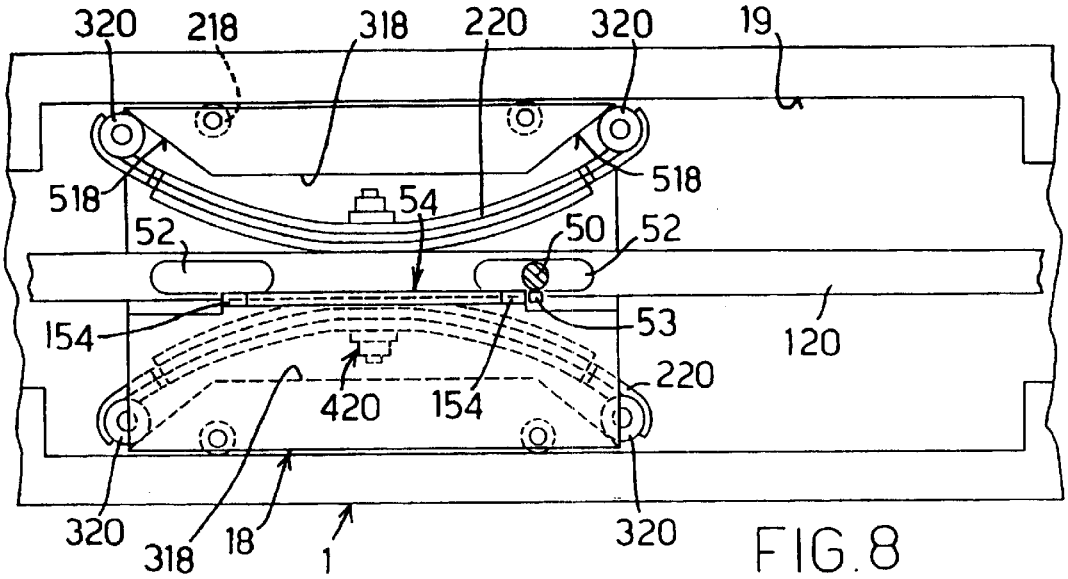

The FIG. 8 shows an enlarged plan view on the transmission rod-carrying slide in the closed position of translation with the guide integral with the drive slide.

Figure 9:
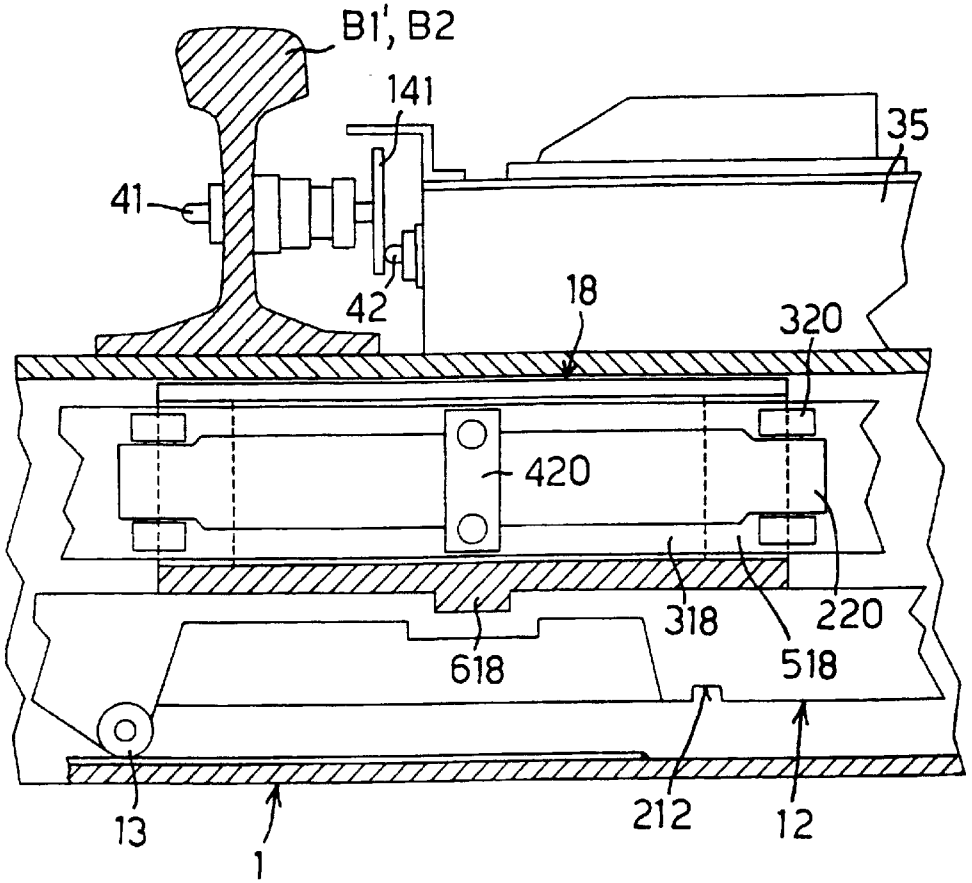

The FIG. 9 shows an enlarged lateral cross-section in elevation of the rod-carrying saddle and of the drive slide.

Figure 10:
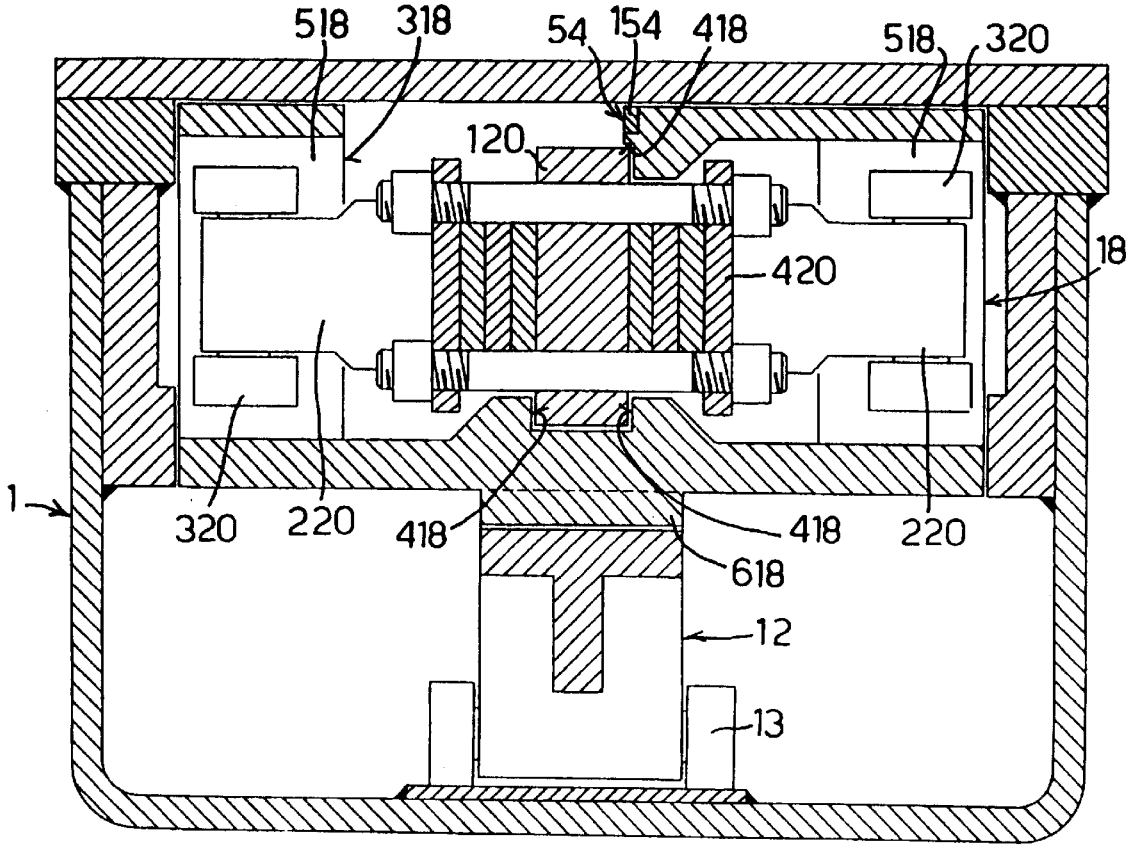

The FIG. 10 shows a lateral cross-section of the rod carrying saddle and of the drive slide.

Figure 11:
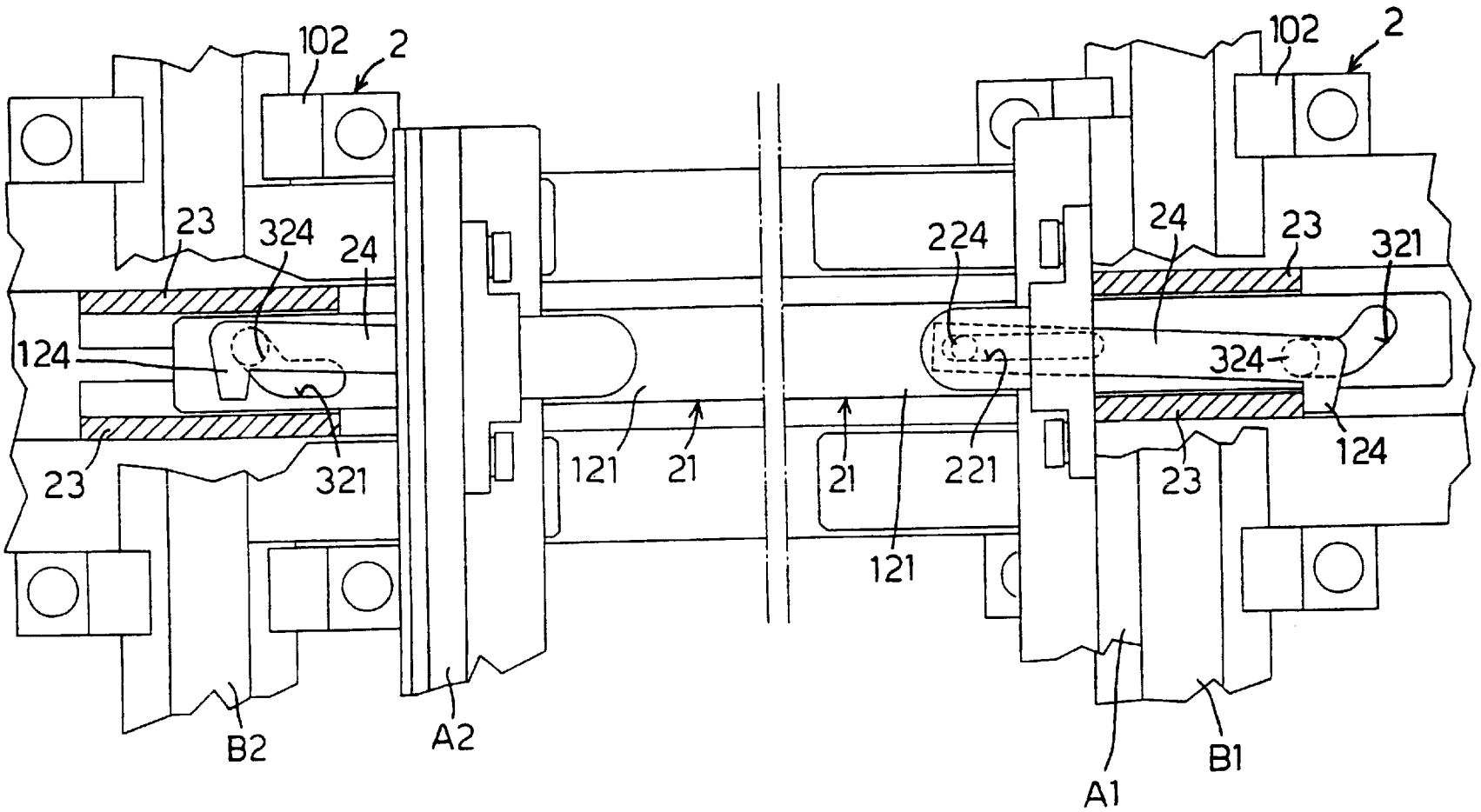

The FIG. 11 shows an enlarged partial view of the switch according to FIG. 1 in which only the area of the two external blades and the locking means relative to the same can be seen.

Figures 12, 13, 14:
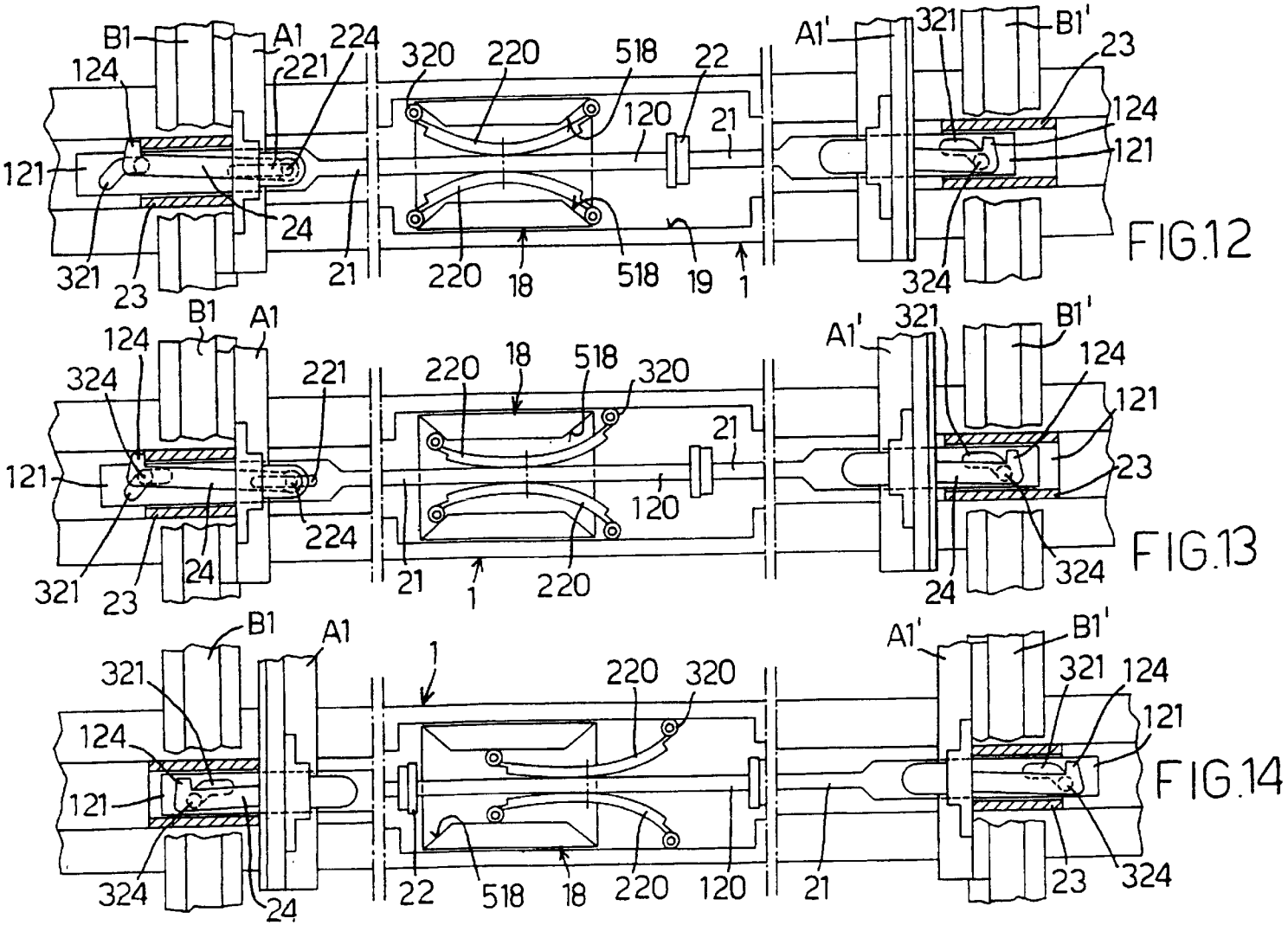

The FIGS. 12 to 14 show some phases of disengagment of the drive slide and the rod-carrying saddle in kicking condition and/or of impediment of the blade upon reaching the correct position of closure.

Figure 16:
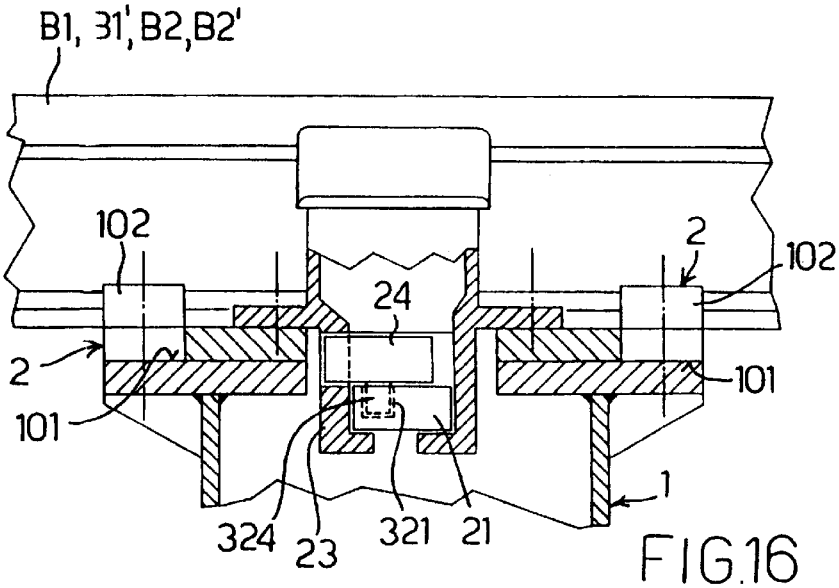
Figures 15, 19:
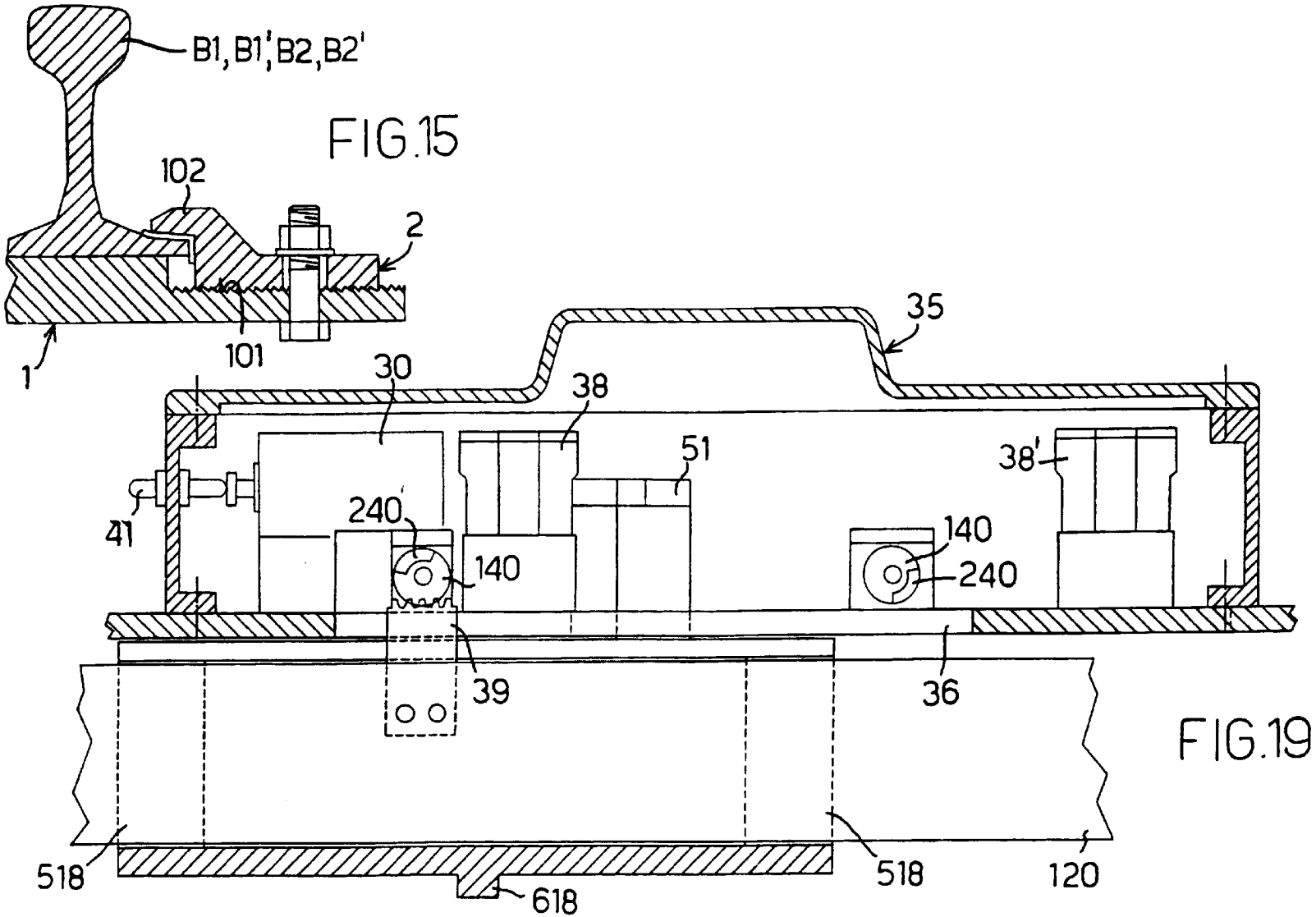

The FIGS. 15 and 16 show the locking means of the rails to the switch box.

The FIGS. 17 to 20 show different views and different cross-sections of the box for the blade position sensors, of the rod-carrying saddle and of the drive slide and the means for transforming the switch box from kicker to non-kicker.

DETAILED DESCRIPTION

Figure 2:
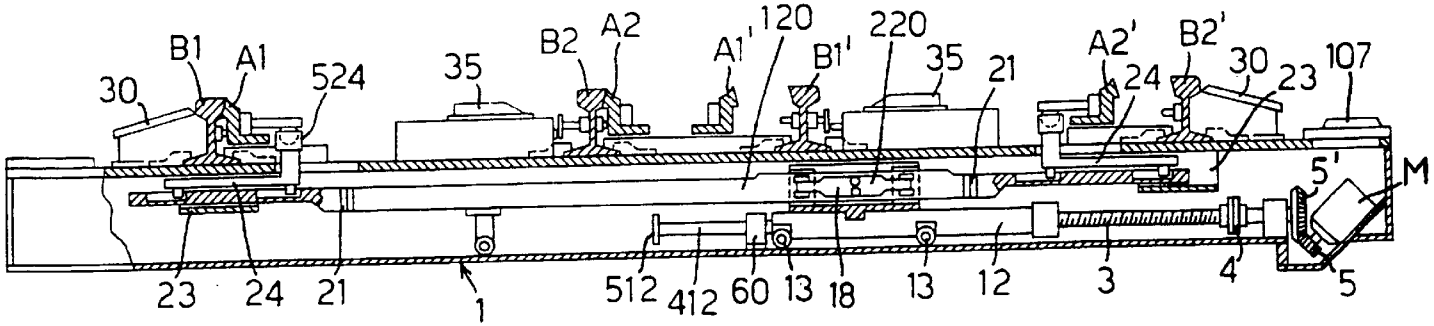

In the FIGS. 1 and 2 a so-called english switch is shown, of the type foreseen in correspondence to crossings and with four blades. In the english type swich two tracks are provided with the rails B1, B1' and B2, B2' which co-operate with the blades A1, A1' and A2, A2' respectively. In a box 1 with shape and dimensions corresponding substantially to those of a sleeper, are housed the means for shifting the blades A1, A1' and A2, A2'. The switch box 1 in the shape of a sleeper has laterally widening fins 101 (FIGS. 15 and 16) which engage with the rail clips 2 of the rails B1, B1', B2, B2'. These have a head 102 to overlap the rail foot of the rails B1, B1', B2, B2', while the remaining part consists of a tail which is clamped by means of bolts to the fins 101. According to an advantageous perfectioning, one or both surfaces of contact facing each other of the rail clip 2 and of the fins 101, can have teeth, or better a knurling parallel to the longitudinal axis of the track. This allows to obtain both a better registration of the relative position of the two parts, as well as a better clamping with regards to a relative translation between fin and rail clip 2.

The switch box 21 in the shape of a sleeper extends itself for a certain length also outside the track substantially in a dimension corresponding to the sleepers and in one of said external extentions of the extremities is housed a drive motor generally of the electrical type indicated with M. The motor M activates by rotation by means of a bevel gear 5, 5' transmission a threaded rod 3 which is connected to the output shaft 5" of the transmission by means of a coupling 4 which can be of any type also of the type that disengage under condition of stress greater than a preset torque or clutch type.

Advantageously as evidenced in greater detail in FIG. 3, in combination with the drive motor M it is possible to provide means for manual activation which can consist of a crank 6 with a shaft 106 at the end of which a bevel gear 206 is provided that engages with a bevel gear 5'" it also revolving together with the output shaft 5" of the transmission which is coaxial the bevel gear 5' connected to the motor. The two bevel gears 5' 5'" are coaxial and have different diameters to ensure the appropriate transmission ratios suitable for driving with the motor M and for manual drive with the crank 6. The crank 6 can be inserted into position of engagement with the bevel gear 5'" of the transmission through an opening 7 in shape of a revolving support sleeve of the box 1 equipped with a lid 107.

A Nut screw 8 is inserted on the threaded rod 3 which is housed in a manner to move freely axially between two opposite end of stroke stops 9 which are provided at the extremity on a first drive slide 12. The drive slide 12 can slide in the two directions in the longitudinal sense of the threaded rod 3 on the bottom of the box 1 thanks to the wheels 13. The nut screw 8 is connected in a reciprocally non revolving manner and translatable together thanks to a radial key 10 to a slide 11 which is therefore movable relative to the drive slide 12 between the two end of stroke stop walls 9 (FIGS. 7, 8).

The free travel of the nut screw 8 between the two end of stroke stops 9 is inferior to the global travel necessary to shift the blades between the two positions of closure of the blades A1, A2 and A1' and A2' respectively to the corresponding rail. Therefore at the start of each phase of activation of the switch, the nut screw 8 and the slide 11 carry out a certain idle travel. This travel is used to activate in sense of disengagement the locking means of a first drive slide 12.

The drive slide 12 is provided with wheels 13 and has in the middle area of bottom recess 112 provided with two notches 212 engaging a locking tooth 14.The locking tooth is supported by spring loaded means 15 which push it firmly in position of engagement in the notches 212 and protrudes out of at least one lateral side of the slide 12 at least in the area of the notches 212, preferably of both sides of the drive slide 12. The slide 11 has in a position protruding from the lateral sides of the same respectively one roller 111 of a pair of coaxial rollers. The rollers 111 engage with cam tracks 116 realized by appropriate profiling of an longitudinal end edge in the example the lower one of the two levers 16 oscillating between themselves perfectly aligned, coincident and symmetric and which are fulcrated on the same shaft 316 which is supported by two stationary elements 616 placed on the two sides of the drive slide 12 and between which the said slide can freely pass during its travel. The two oscillating levers 16 extend themselves beyond the fulcrum shaft 316 towards the middle area of the drive slide 12. The two oscillating levers 16 extend themselves along the two sides of the slide 12 up to the area of the slide 11 and the nut screw 8. On the side opposite to the nut screw 8, the oscillating levers terminate with a pressure head 416 which engages with the section of the locking tooth 14 of the drive slide 12 protruding out of the sides of the same.

The whole is realized in such a manner, whereby in position of end of stroke of the driving slide 12, the rollers 111 of the slide 11 connected to the nut screw 8, come to engage with the recessed area of the profiled edge of the lower end of the levers 16, whereby the opposite extremity of pressure of the tooth is lifted from the locking tooth and this can under spring load penetrate into the notch 212 of the drive slide 12. Upon movement in the opposite direction of the drive slide 12, the nut screw 8 and with it the slide 11 performs a certain idle travel that is with regards to the same slide 12, and the rollers of the slide 11 come to engage with the protruding area of the profiled lower front edge of the oscillating levers. In this condition, the pressure ends of the oscillating levers 16 engage with the tooth pushing it out of the notch 212 against the action of the spring. In this manner the drive slide 12 is released with regards to its translation before the nut screw 8 and the slide 11 come to stop against the end of stroke wall 9, that is before the slide 12 starts to be driven or pushed. The leaf spring associated with the tooth, not only retains the tooth in position of engagement in the notches 212, but also presses under spring load the levers 16 against the rollers 111.

The FIGS. 4 and 5 show the starting phase of the travel unlocking the drive slide 12 by the nut screw 8 and the slide 11. In FIG. 4, the slide has reached the end of stroke position corresponding to a motion to the left in direction of the arrow F1. The reversal of the direction of displacement of the slide indicated with F2, causes a first idle travel of the nut screw 8 and of the slide 11 until they come to a stop against the wall 9. During this travel the rollers 111 have come into contact with the protruding area of the profiled lower leading edge 216 of the levers 16, whereby the extensions 416 acting on the tooth 14 pushed it out of the notch 212 and the slide 12 is free to slide when the nut screw 8 and the slide 11 have come to a stop against the end of stroke wall 9. Therefore further displacement of the nut screw 8 along the threaded rod 3 causes the drive slide 12 to move in direction of the arrow F2.

The end of stroke positions of the drive slide 12 are defined by a stationary stop 60 integral with the bottom of the box and through which passes an axial extension 412 of the slide 12 which has an enlarged striker 512 on the extension at its free extremity. In the two end of stroke positions one of the two faces of the end of stroke stop 6 comes into contact with the enlarged striker 512 on the extension 412 and the front end of the slide 12 respectively on which said extension is fitted.

On the drive slide 12 in a superimposed position is an integral guide 19 for a rod carrying saddle 18 which is integral with the translation of the drive slide 12, thanks to a vertical pin or other fixed joint 618 and slides along the longitudinal side walls of the guide 19 in the box 1 thanks to the rollers 218. The rod-carrying saddle 18 is of tubular construction, and the side walls of the same have a plan form in shape of isosceles trapezoids, forming at the opposite ends of each side wall 318 of the rod-carrying saddle 18 inclined surfaces 518 in a direction simmetrically opposed to each other and converging towards the central area of the very slide 18. In the central area the rod carrying saddle 18, has on the bottom and on the top side, a double slide guide respectively, that is on both sides or one side 418 for instance longitudinal central grooves, or half of the same, in which the extremities of a central rod 120 are housed. The central rod 120 is connected to the rod-carrying saddle 18 thanks to a pair of carriage springs 220. Each of the two carriage springs is connected with the extrados side and in a simmetrical position with regards to the other carriage spring to the central rod 120, whereby the plan seen from above has substantially the shape of an "X", cut vertically in half by the rod 120. Each of the free extremities of the carriage springs 220 has a roller 320. The carriage springs 220 are dimensioned in such a manner, that each roller 320 engages with an inclined surface 518 of the rod-carrying saddle 18. In particular, the rollers 320 at the extremities of each carriage spring 220 engage for each carriage spring respectively with the inclined surfaces 518 on the end sides of the very side of the rod-carrying saddle 18 towards which the carriage spring is faced.

The central rod 120 is fixed to the carraige springs 220, substantially at one single point, in particular in correspondence of the point or more precisely of the tangential band of the carriage springs 220 to said rod 120 by means of a locking clamp 420.

The central rod 120 connects at both its extremities thanks to the joints 22 with the transmission rods 21 which extend themselves up to the area underneath the corresponding rail B1, B1', B2, B2'. The extremity 121 of the transmission rods is in shape of a plate, in the horizontal example and slides between two lateral guide walls 23. In the extremities 121 of the transmission rods 21 a first elongated slot 221 is made in the top face which has a certain preset length and is foreseen closer to the coupling 22 to the central rod 120 of the rod-carrying saddle 18 and at a preset distance from this first groove 221, in the end area a second angular elongated slot 321. The first slot 221 is rectilinear and the axis of the same is parallel and coincident with the central longitudinal axis of the corresponding transmission rod 21. The second slot 321 forms an obtuse angle and has a branch parallel to the central, longitudinal axis of the corresponding transmission rod 21, but laterally offset relative to the latter, substantially in a measure corresponding to the length of the tooth 124 of an oscillating lever 24, and a transversal, inclined branch which substantially terminates in correspondence to the central area of the transmission rod 21. The length of projection of the second slot 321 on the longitudinal axis of the corresponding transmission rod 21 is substantially identical to the total length of the first slot 221.

On the extremity 121 of each transmission rod 21 rests an oscillating lever 24 which is angled at its extremity in correspondence to the free extremity of the transmission rod 21 in order to form a coupling tooth 124. From the lower rest surface of the oscillating lever 24 depart in a position coinciding with the slots 221 and 321 two transversal pins 224 and 324 which engage in the corresponding slots 221 and 321 of the extremities 121 of the transmission rods 21. A pin 224 is provided in correspondence of the extremity of the oscillating levers 24 facing the rod-carrying slide 18, while the other pin 324 is provided in an aligned position with the first 224, with reference to the longitudinal axis of the longer branch of the oscillating levers 24 and in the area of the angle of the same. The distance between the two pins 224 and 324 is substantially corresponding to the distance of the projections on the longitudinal axis of transmission rods 21 of the extremities, on the same side, of the slots 221 and 321, in such a way, that when the pin 224 stops against one of the extremities of the slot 221, the pin 324 stops against the end on the same side of the angled slot 321 which in this case has the function of a guide track of the pin 324 and determines an angular displacement in the horizontal plane of the oscillating lever 24, whose travel is sufficient to bring the lever alternately into position of engagement of the tooth 124 on the front end of the facing wall of the lateral guide 23 and in the position of disengagement of the same thanks to a relative displacement between transfer rod and oscillating lever 24.

In coaxial position to the locking pin 224 in the rectilinear slot 221 of the transmission rod 21, from the top side of each oscillating lever departs a transversal extension connected to the point which is formed by a bolt 424 with a head 524 in form of a spherical joint seat for a ball joint type appendix 25 integral with the blade A1, A1', A2, A2', in such a way, that the oscillating lever 24 is coupled with the corresponding blade A1, A1', A2, A2, in a revolving manner at least around the common axis with the pin 224 of the very lever 24. The spherical appendix 25 departs from a small arm 125 fixed on the blade A1, A1', A2, A2', in particular to the longitudinal lateral surface of the same.

With refernce to the FIGS. 1 to 14 the construction as per above, allows to obtain the following operation:

Operation under normal conditions.

Activating the threaded rod 3 whether by means of the motor M or the help of the crank, in order to obtain the displacment of the blades from one initial position of closure of one of said blades to the corresponding rail in the closed position of the blade opposite to the associated rail, at the start of the travel of the nut screw 8 and of the slide 11 associated with the same, relative with regards to the drive slide 12, (FIGS. 4 and 5) the rollers 11 activate the locking levers 16 so as to release the drive slide 12 from the locking tooth 14. Upon reaching the end of stroke stop 9 on the side facing in direction of travel of the drive slide 12, this starts its travel and drags with it the rod-carrying slide 18 above it together with the rod 120 and therefore together with the transmission rods 21. In the initial start-up position, the pins 224 and 324 of the oscillating levers 24 coupling with the blades initially closed stop against the extremity of the associated slots 221, 321 on the side of the same in front with regards to the direction of translation of the transmission rods 21. Therefore, in an initial phase of the travel of translation of the transmission rods 21, the transmission rod 21 associated with the closed blade in the start-up position carries out a relative motion with regards to the very blade and to the coupling oscillating lever 24. The relative motion is such as to bring the lever 24 associated with the blade in position of closure in the start-up condition, into position of disengagement from the edge of the lateral guide wall 3, while on the opposite side, the guide rod has executed a relative motion such, that the oscillating lever 24 associated with one or more blades which have to be brought into position of closure assumes a slightly inclined position and substantially of rest against the internal surface of the side wall of the guide 23 associated with it. Upon reaching this position, the pins 324 of all oscillating levers 24 connected to the corresponding blades A1, A1', have reached substantially an intermediate position between the extremity of the inclined branch and the extremity of the same in the angle area of the corresponding slots 321. The oscillating levers 24 are retained in this position by effect of the lateral guides 23 against which they slide in their further travel during which, the arms 24 and with them the blades are driven together with the transmission rods 21. The blade reaches the position of closure and at the same time the tooth 124 of the coupling oscillating lever 24 passes beyond the rear edge of the facing side wall of the guide 23, with reference to the direction of translation of the transmission rods 21, whereby the further translation of the transmission rods 21 determins the subsequent oscillation, especially of the oscillating lever 24 associated with the blade that has been brought into position of closure, into the position of engagement behind the facing front edge of the lateral guide walls. The oscillating lever of the blade that passed into the position of moving away from the associated rail is subsequently brought into a central position with regards to the lateral guides 23.

In this way, the blade in position of closure is locked in position.

Upon reaching the position of closure opposite to the one at the start, the rollers 111 of the slide 1 associated with the nut screw 8 reach a new recessed part of the control cam 216 obtained thanks to the profiling of the oscillating levers 16 which are supported stationary on a lateral support 616 through which passes the drive slide 12, so that the locking tooth 14 of the drive slide 12 penetrates into the corresponding notch 212 of the same, locking it in the position of closure it just reached.

With reference to the english type switch shown in the Figures, in which two pairs of blades A1, A1' and A2, A2' are provided, as the blades of the two pairs must assume the positions of closure constrained to each other for each pair, one single drive slide 12 is sufficient, with one single rod-carrying saddle 20 for all four of the blades. Besides the fact that four blades are provided, the english style switch differs from the normal one in that for the blades A2 and A1' in the central area of the switch it is not possible to provide specific means for locking in position. Therefore, in these conditions, having the blade A1 of a pair to assume the position of closure together with the blade A2 of the other pair, the same are rigidly constrained together by a rod 26, while the locking means, that is the coupling oscillating lever 24, is provided only outside the track and in correspondence of the blade A1. The same identical construction is also foreseen for the blades A1' and A2' which assume together the position of closure to the respective rail.

From the above description it becomes evident that the construction of the switch box for a traditional switch with only two blades is perfectly identical to the english type switch and inferable from the same by simply eliminating the rods 26 and the internal blades A2, A1'.

With particular reference to the FIGS. 12 and 14, the particular construction of the rod-carrying saddle 18 makes the switch a kicker type. This means, that the switch can be activated by a train suddenly arriving from an opposite direction to the arrow T in FIG. 1 and from the incorrect track, will act with the wheel on the unlocked blade.

In these conditions, the wheel of the train exerts a force of displacement in direction of closure of the blade not locked to its associated rail and if the blade of the switch should not yield this would entail braking the same or in any case a derailment.

Thanks to the coupling carriage springs 220 and the rod-carrying saddle 18, when on the unlocked blade a force of displacement of the same is exercised in direction of closure to the corresponding rail, and when this force is greater than the spring loaded one of the carriage springs 220, the rollers of the rear branches of the two opposed carriage springs 220 slide against the inclined planes 518, overcoming them and compressing the two associated branches of the carriage springs 220 one against the other, so that the central rod 120 and the associated transmission rods 21 are free from the drive slide 12 and can translate in the direction of the force exercised by the blade. The mechanism of the coupling oscillating lever which is perfectly independent from the one of the drive slide works in an analogous manner to the one decribed previously.

According to an advantageous feature, the inclined planes have a length such, that the sliding of the rollers from one extremity to the other of the same corresponds substantially to the length of the section of the angled slots 321 of the transmission rods that is rectilinear and parallel to the longitudinal axis of the transmission rods so that as evidenced in FIG. 13, as long as the rollers remain on the inclined planes 518 and do not reach the intermediate zone of the lateral walls of the rod-carrying saddle 18, the oscillating levers 24 with the locked blades do not pass into a position of disengagement. This allows the mechanism of transmission to absorb slight mechanical stresses exercised on the blades, without causing the abandonment of the switch position.

The rod-carrying saddle 18 integral with the drive slide 12 allows to avoid stresses on the drive motor in case mechanical obstacles come between the blade and the corresponding rail during the closing phase. As a matter of fact if for example a stone or other prevents the rail to assume the final locking position, the drive slide can in any case be brought into the position of end of stroke, with a disengagement of the central rod 120 of the rod-carrying saddle 18 analogous to the one described in the phase of kicking.

With reference to the FIGS. 1, 3 and 17 and 19, the switch box has sensors for the position of the blades, of the central rod 120 and the drive slide 12.

For the external blades of the english type switch illustrated, as well as for the blades of a normal switch the position sensors consist of limit switches 30 housed in small boxes 31 which adhere to outside the of the rail. The switches 30 are activated by a small rod 32 that passes transversly through the rails, protruding on the inside of the same against which acts the side of the blade facing it.

In the english type switch and the normal switch the end of stroke sensors of the central rod 120 and of the drive slide 12 are housed in a small box 35 on top of the switch box in the central section of the track or tracks B1. B1', B2, B2'.

Figure 17:
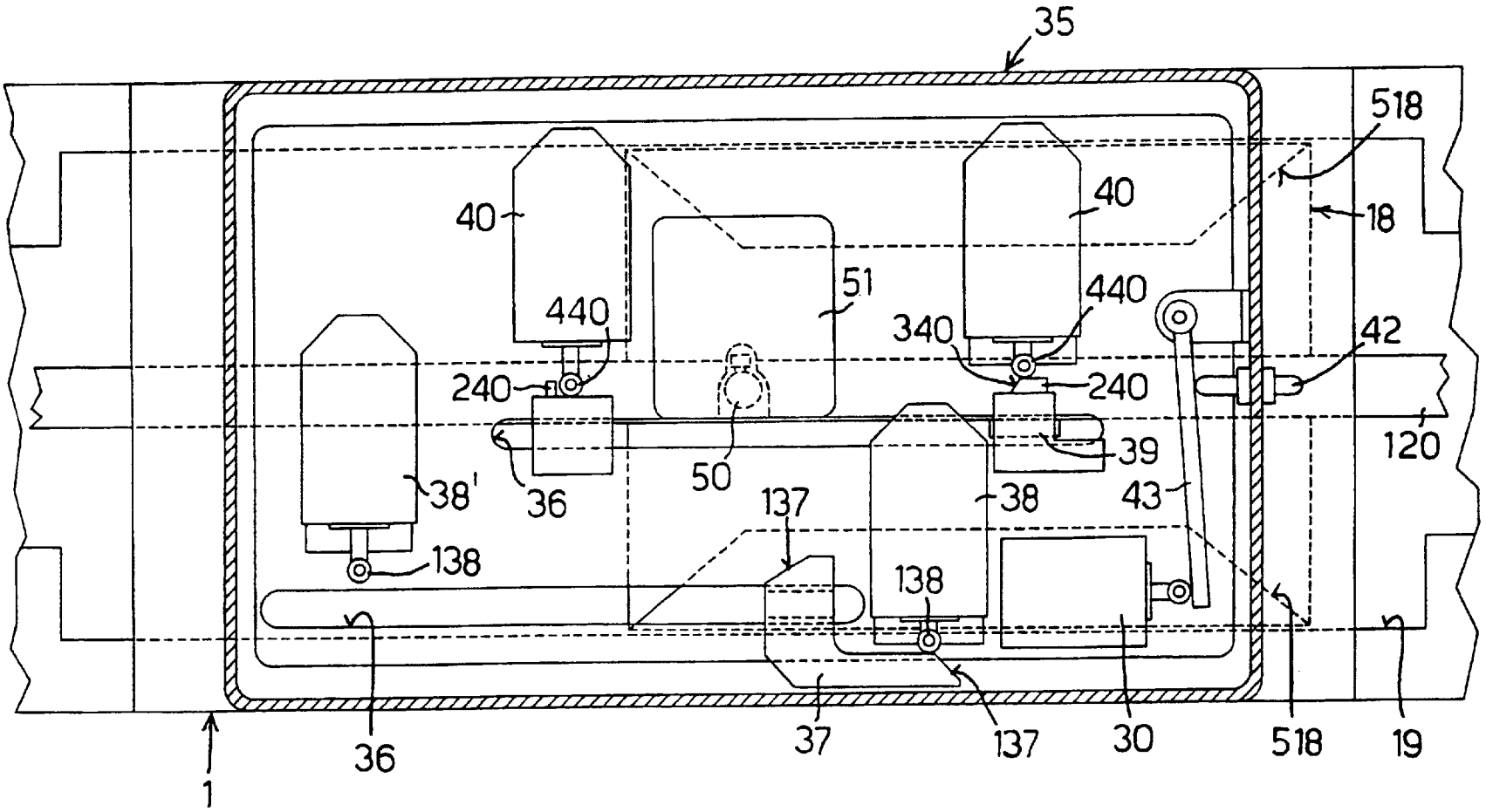
Figure 18:
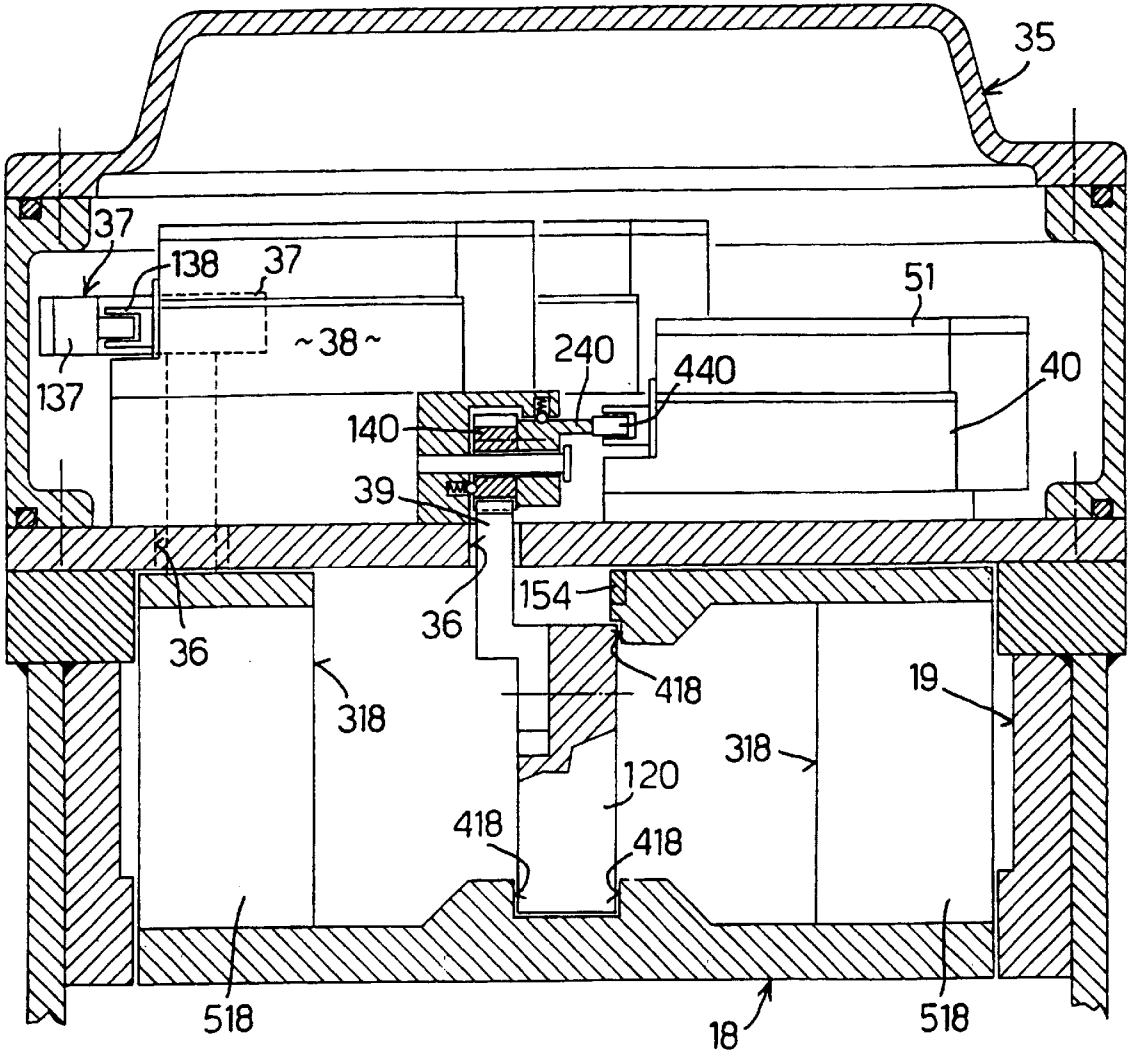

The FIGS. 17 and 19 show hybrid forms of execution of a small box 35 in that in combination with each other all the functionalities are provided whether for the english type switch or for the normal switch. In reality, as evidenced in FIG. 1, as the english type switch can be equipped with two small boxes 35, the means illustrated with reference to the FIGS. 17 and 19 can be distributed on said two small boxes.

Through a slot 36 in the bottom of the small box 35, at the inside of the same protrudes a slider 37 that is carried by the rod-carrying saddle, tubular 18 and integral with the drive slide 12. The slot 36 has a length corresponding substantially to the travel of the drive slide and is oriented in direction of translation of the same. The slider 37 co-operates with two limit switches 38 and 38' which are located at the end sections of the slot 36 at a distance and in a position corresponding to the stroke of the drive slide 12 and to the end of stroke positions of the same. The slider 37 acts thanks to inclined lead-in surfaces 137 on the trip buttons 138 of the switches.

The position sensors of the central rod 120 are made in a similar manner. A slot 36 oriented in direction of translation of the transmission rods 21 and of a length corresponding to the stroke of the same is provided in the bottom of the small box 35 coincident with the central rods 120. Through the slot 36 protrudes in the interior of the small box a small segment of the rack 39 which engages with toothed rollers 140 associated with each of the two limit switches 40 arranged at appropriate distances and in appropraite positions analogous to what described for the drive slide 12 in the section of the extremities of the slot 36. The toothed rollers have an axial tooth 240 on the side facing the switches 40 this tooth extending itself over a certain angular amplitude and connects with inclined sides 340 with the remaining section of the front edge of the roller 140. The axial tooth 240 trips the pushbutton of the switch 40 and according to the position of the roller determined by the rack, the pushbutton 440 will be depressed or not. The passage of the rack over the toothed rollers determines therefore the signal of position of the central rod 120.

The central small box relating to a normal switch has the same identical sensors for the drive slide 12 and for the central rod 120.

Furthermore, in the central small box 35 of the english type switch position sensors are provided for the internal blades A2, A1'. In this case, with particular reference to the FIGS. 9, 17 and 19, a small activating rod 41 is foreseen analogous to the one for the outside rail A1, A2' and which passes from side to side through the associated rail B1'. B2. The protruding extremity at the side of the opposite rail acts thanks to a pressure plate 141 on a further small rod 42 which is supported sliding in the wall of the small box 35 and which protrudes on the inside of the same, where it acts against an intermediate point of a transversal oscillating lever 43, the free extremity of which acts in a manner of compression on the pushbutton tripping the limit switch 50.

The small box 35 foreseen in the english type switch can only house the position sensor of the second internal blade A1', which is realized analogous to what described in the preceding paragraph, or rather it also can house position sensors for the drive slide 12 and the central slide 120 realized analogous to the one previously described, where in this case the slider 37 and the rack 38 are associated with other parts 1integral with the drive slide 12 and the central rod 120.

Figure 20:
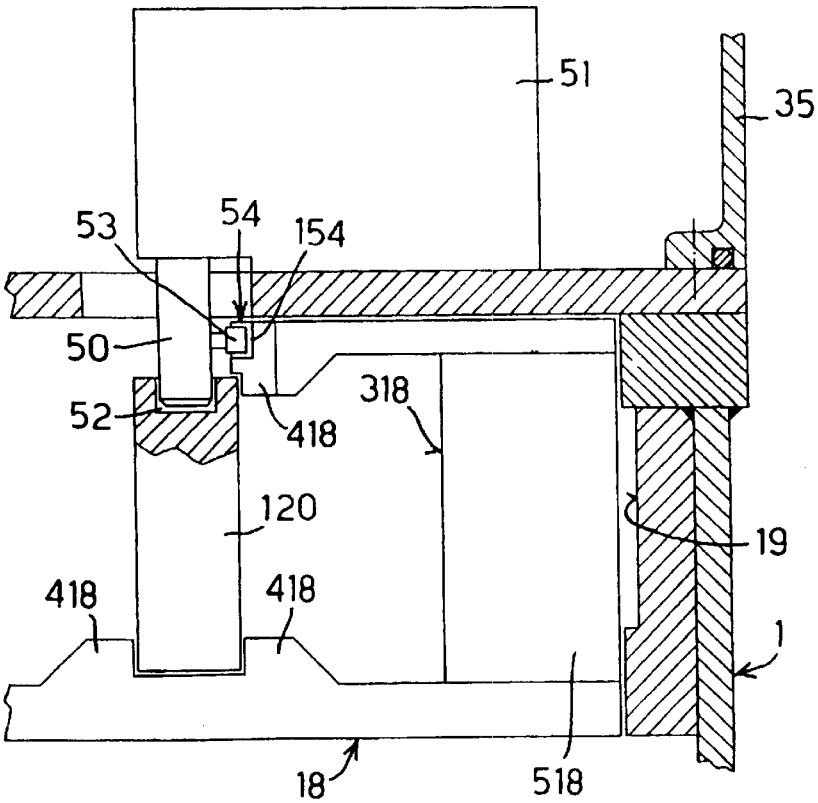

With reference to the FIGS. 8, 17, 20 according to a further feature, it is possible to provide means with which to constrain firmly and in a movable manner the rod-carrying saddle 18 and therefore the drive slide 12 to the central rod 120, thus enabling and disenabling the function of kicking of the switch. In particular this can be obtained thanks to a transversal, vertical pin 50 which engages in coincident holes or seatings in the central rod 120. The pin 50 can be inserted manually thus impeding the heeling of the switch if not thanks to a manual intervention of modification or can be controlled in the two positions in an automatic manner, for example thanks to an electromagnet 51 whose activation or deactivation bring the pin 50 in position of engagement or disengagement of the central rod 120. The whole can also be made in a different manner and with other actuating means.

Also this feature can be provided indiscriminately and without noteworthy variations or modifications whether in the english type switch illustrated as an example or in the normal switch with two blades.

According to an advantageous feature, the pin 50 engages with slots 52 in the central rod 120, whose length is such to allow within preset limits a certain relative motion between the central rod 120 and the rod-carrying saddle 18. This in particular to allow the rod-carrying saddle 18 and the drive slide 12 to always reach the end of stroke position where the motor M is deactivated also in the case when obstacles are found between the blade and the closure rail of the same which prevent the blade from locking in the end of stroke position against the rail.

The slots 52 have such a length, that the relative travel between the central rod and the saddle which in the case indicated above takes place against the action of the carriage springs 220 keep the rollers of the carriage springs always within the range of the inclined planes 518 of the rod-carrying saddle 18. Therefore, the central rod can carry out small relative motions with regards to the rod-carrying saddle 18 and to the drive slide 12, but can never be disengaged as in the case of the FIG. 14 when the switch is of the kicker type.

The pin 50 can simply be engaged or alternatively engaged and disengagned on comand thanks to the electromagnet 51.

To allow for the activation of the switch, also in the case the pin is not automatically controllable in the active and inactive position, meccanical means are provided which bring the pin 50 automatically in the inactive position upon activation of the switch. In the present example for this purpose lifting means are provided associated with the rod-carrying saddle 18 and said means consist of inclined planes 154 of a cam track 54 that co-operate with a roller 53 supported in a revolving manner around an axis transversal to the direction of sliding of the central rod 120 and laterally offset in an aligned position with said inclined planes 154 at the free extremity of the pin 50.

Activating the rod-carrying saddle 18, before the pin 50 reaches the corresponding extremity of the associated slot 52 in the central rod 120, the roller 53 on the pin 50 engages the inclinded plane of the cam 54 carried by the rod-carrying saddle 18 and therefore raises in position of disengagement from the corresponding slot 51 of the central rod 120, leaving the latter free to move together with the rod-carrying saddle 18. Upon reaching the end of stroke position of switching, an opposed inclined plane or an interruption of the cam track returns the pin 50 into the angaged position of the other slot 51 in the central rod 120 re-establishing the kicker condition.

I claim:

1. Switch box comprising a drive unit (M, 3, 4, 5, 5', 5", 5'", 6) of the transfer motion of blades (A1, A1', A2, A2') of a switch, and at least one group (12, 18, 120, 21, 24) for linear transmission of the drive motion to the blades, movable means (24, 124) to lock the blades in their respective position of closure, said groups being housed in the box (1) which has substantially the dimensions and the shape of a sleeper and that is fitted in a track in place of and with the function of the sleeper, characterized by the fact that the movable means (23, 24, 124) are provided for locking the blades (A1, A1', A2, A2') in their respective position of closure, the movable means (23, 24, 124) are associated with their respective blade (A1, A2') and arranged inside the box (1) in the area of the blade (A1, A2') itself and are brought automatically into active locking position upon the corresponding blade (A1, A2') reaching the position of closure, while the movable means are automatically disengaged the moment the switch box is activated to transfer the blade into the position of closure with the opposite blade (A2', A1).

2. Switch box according to claim 1, characterized by the fact that a linear means (12) of transmission in the two directions between two extreme ends of stroke positions of a group (M, 3, 4, 5, 5', 5", 5'", 6) for transforming the rotary motion into linear motion and to which are coupled a transmission rod (21) for each or more blades (A1, A1', A2, A2'), while at least said opposite blades (A1, A2') are connected to a lever (24) coupling with the respective transmission rod (21) thanks to the corresponding movable means (21, 121, 321, 23, 124, 224, 324) locking the blade (A1, A2') in the position of closure.

3. Switch box according to claim 2, characterized by the fact that the transmission rods (21) of the drive motion of the blades (A1, A1', A2, A2') are carried by at least one drive slide (12), and movable lockingqmeans (8, 9, 11, 15, 16, 216, 212) being provided at the two extreme end of stroke positions of the drive slide (12) in addition to the end of stroke stops (60, 412, 512).

4. Switch box according to claim 3, characterized by the fact that the transmission rods (21) can be freed from the mechanical constraint of connection with the drive slide (12) by the action of an external force of displacement on the blades (A1, A1' A2, A2').

5. Switch box, according to claim 3, characterized by the fact that dedicated end of stroke sensors (3, 31, 32, 35, 36, 37, 38, 39, 40) are provided for each of the blades (A1, A1', A2, A2'), for the transmission rods (20, 21) and for the drive slide (12).

6. Switch box according to claim 2, characterized by the fact that levers (24) are foreseen at least for coupling the outermost blades (A1, A2') to the corresponding transmission rod (21), said levers constituting said movable locking means of the blades (A1, A2').

7. Switch box according to claim 6, characterized by the fact that said couplings levers (24) are oscillating and have a lateral tooth (124) at the extremity opposite to their fulcrum, each lever (24) being connected to the corresponding blade (A1, A2') by means of a joint (424, 525, 25) which allows the rotation of the levers (24) around a perpendicular axis while each coupling lever (24) engages with stationary stops (23) in the area of the blades (A1, A2') means (224, 324, 221, 321) provided between each coupling lever and the transmission rod (21) to control the angular position of the same lever (24) such, that, during the activation of the switch, the coupling levers (24), or at least the coupling lever (24) engaged with one of the blades (A1) in position of closure in the condition of start-up, are brought in position of disengagement by the stationary stops of engagement (23), before the translation of the blades (A1, A1', A2, A2') takes place and upon one of the blades (2') reaching the position of closure, the corresponding coupling lever (24) is angularly displaced into position of the end tooth (124) behind the corresponding stationary stop (23) with regards to the direction of motion of the blade (A1) closed in position of moving away from its associated rail (B).

8. Switch box according to claim 7, characterized by the fact that the means of control of the angular motion of the coupling levers are constituted by slots or shaped grooves (321) which form control tracks made in the transmission rods (21, 121) and with witch engages at least one appendix (324) protruding from the facing side of the coupling levers (24).

9. Switch box according to claim 7, characterized by the fact that the axis of oscillation of the coupling levers (24) occurs in the area of the means connecting the coupling levers to the corresponding blade (A1, A2'), while the coupling lever (24) extends itself beyond the blade (A1, A2') in direction of the associated rail (B1, B2') inside lateral guides (23) oriented in direction of motion of the transmission rods (21) and while said rod is substantially vertical and the coupling levers rest on the associated ends of the transmission rods (21).

10. Switch box according to claim 7, characterized by the fact the coupling levers (24) are moved alternatively from the position of engagement with the stationary stops (23) to the position of disengagement, corresponding to a relative motion of the transmission rods (21), in an initial or end stretch of the stroke driving the same transmission rods (21).

11. Switch box according to claim 2, characterized by the following combinations of features:

the transmission rods (21) have an angled groove (321) in which engages in a sliding manner at least one driving pin (324) of a corresponding coupling lever (24);

each angled slot or groove (324) has a section parallel to the mean longitudinal axis of the transmission rods (21) and which is arranged laterally offset along the side of said mean longitudinal axis and said section extends itself towards the free extremity of the transmission rods (21) with an inclined section which substantially ends in the area of the mean longitudinal axis of the transmission rods (21), or in any case in an intermediate area of the transversal dimension of said transmission rods (21);

stopping means (23) with which engage the lateral teeth (124) of the coupling levers (24);

the stopping means (23) limiting the oscillation in direction of engagement with the associated stops (23) of the coupling levers (24), in the part of the stroke in where the coupling levers (24) are dragged by the transmission rods (21);

the position and shape of the slot (324), as well as the projection of the tooth (124) of transmission levers (24) and the conformation and position of the means (230) of engagement of the lateral teeth (124) of the coupling levers (24) and of the means (23) limiting the oscillation during the stroke, being dimensioned and arranged in such a manner, that in the initial stretch of the drive stroke, the transmission rods (21) move relative to the coupling levers (24) as long as the coupling lever (24) which is in the engaged position, being connected with the blade (A1) closed in start-up position, is brought into position of disengagement by the stop (23), while the lever (24) in position of disengagement, being connected with one of the blades that is to be taken into the position of closure (A2'), is limited relative to its angular displacement by said limiting means (23) in such a manner, that the appendix (324) projecting from said coupling levers (24) in the area of the tooth (124) and engaged in the angled slot (321), positions itself at an intermediate point of the inclined section of said grooves or slots (321), whereby, the inclined wall turned in direction of motion of the blades (A1, A2'), of each slot (321) becomes connected to the blade (A2') which must be brought into position of closure by the lateral guides, the surface of engagement for driving the same corresponding coupling lever (24) together with the rod (21) and when in the position of closure of the blade (A2'), the coupling is lever (24) free from the means (23) limiting the angular motion, it oscillates further being brought in position of engagement with the corresponding stationary stop (23).

12. Switch box according to claim 11, characterized by the fact that the means limiting oscillation of the coupling levers (24) and the engagement stops of the teeth (124) of the coupling levers (24) are constituted by the assembly of lateral guide walls (23) of the transmission rods (21) and the coupling levers (24), said walls (23) are arranged at a preset distance between themselves, and by the end sides opposite to the centerlines of the track of one of said lateral guide walls (23), said end sides are arranged in such a position, that when the tooth (124) of the coupling levers (24) has just passed the same, the blade (A2') is in position of closure, while the lateral guide wall (23) facing in direction of the lateral tooth (124) of the corresponding coupling lever (24) constitutes one sliding and limiting wall in the position in where the appendix (324) of the coupling lever (24) is substantially positioned in the central area of the inclined branch of the corresponding drive slot (324) in the transmission rod (21).

13. Switch box according to claim 1, characterized by the fact that each transmission rod (21) has a second slot (221) substantially parallel and coincident with the mean longitudinal axis and in which is housed a pin (224) of the corresponding coupling lever (24) or similar which is movable along the rectilinear slot or groove (221) and which relative to the angular displacement of the coupling lever (24) is coaxial to the means (424, 524, 25) coupling the lever (24) to the blade (A1, A2'), or a joint at least of a rotary type.

14. Switch box according to claim 13, characterized by the fact that the transmission rods (24) are connected (120, 220, 320, 518) to a common rod-carrying saddle (18) supported in a movable manner substantially in a direction orthogonally to the axis of the track, the said rod-carrying saddle (18) is connected permanently to a drive slide (12), while the transmission rods (21) are coupled to the rod-carrying saddle (18) by movable coupling means (220), 320, 218, 518) which pass into position of disengagement from the same and from the drive slide (12) when the resistance to the translation of the blades (A1, A1', A2, A2') exceeds a certain preset torque, or when a force is applied in the direction of motion directly on the blades (A1, A1', A2, A2'), whereby the same rods of transmission (21) are translated relative to the rod-carrying saddle (18) against a preset torque coupling the same to the rod-carrying saddle (18).

15. Switch box according to claim 14, characterized by the fact that the transmission rods (21) are coupled to the rod-carrying saddle (18) by means of a central rod (120) which has rollers (320) revolving in the sliding direction of the same transmission rods (21) are supported in a spring loaded manner (220) movable transversally to the sliding direction of the transmission rods (21) against a preset spring loaded force, while each roller (320) engages with an inclined plane (518), foreseen in the rolling walls (218) on the rod-carrying saddle (18), two inclined planes (518) being provided, relative to the sliding direction of the rod-carrying saddle (18) and with inclinations simmetrically opposite each other on each of the two opposite rolling walls (218) for the rollers (320), being foreseen for each inclined plane (518) at least one corresponding roller (320) connected to the transmission rods (21) to a common central coupling rod (210).

16. Switch box according to claim 14, characterized by the fact that the central coupling rod to the transmission rods (21) has two rollers (320) for each rolling wall of the rod-carrying saddle (18), said rollers (320) are supported at the extremities respectively by a carriage spring (220) and the two carriage springs (220) being fixed to each other, on the two longitudinal sides of the central connecting rod (120) in correspondence with the extrados sides of said springs (220) and the length of the carriage springs (220) being such, that in condition of engagement of the central rod (120) with the rod-carrying saddle (18) and the drive slide (12), the rollers being foreseen at the outermost extremity of the corresponding inclined plane (518).

17. Switch box according to the claim 4, characterized by the fact that the rod-carrying slide (18) is mounted on an upper guide (19) of the drive slide (12) and has two opposed lateral walls oriented in the sliding direction of the transmission rods (21) on the walls of which are provided two projections (218) in shape of an isosceles trapezoid which are facing and coincident between themselves and whose inclined sides form the inclined planes (518) engaging with the rollers (320) of the central rod (120) at the two opposite ends of which are connected two transmission rods (21).

18. Switch box according to claim 14, characterized by the fact that movable locking means (3, 8, 9, 10, 11, 12, 212, 14, 15, 16) are provided for the drive slide (12) in the two end of stroke positions of closure of the one or the other blade (A1, A1', A2, A2').

19. Switch box according to claim 18, characterized by the fact that said movable locking means of the drive slide consist of oscillating means (16) for the disengagement of a locking tooth (14) elastically pressed in a stable manner (15) in direction of engagement in one or more notches (212) distributed along a longitudinal side of the drive slide (12).

20. Switch box according to claim 19, characterized by the fact that a rocker is provided, constituted by at least one oscillating lever (16) oscillating around an axis (316) transversal to the run of the drive slide (12) and which extends itself parallel to said run, said axis (316) of oscillation is stationary with regards to the drive slide (12), forming at one extremity of the oscillating lever a means of pressure on the locking tooth (14) of the drive slide (12) for displacing the same alternatively into a position of engagement and a position of disengagement with one of the notches (212) in the cooperating walls of the drive slide (12), while the other part of the oscillating lever, on the opposite side of the axis of a fulcrum (316), shaped in form of a control cam (216) which engages with at least one roller (111) movable together with said means (8, 9) coupling the drive slide (12) to the linear actuator.

21. Switch box according to claim 20, characterized by the fact that the rocker is constituted by two levers (16) integral and coincident with each other, each of which extends itself along the lateral longitudinal sides of the drive slide (12), said oscillating levers (16) being fulcrated on the same axis (316) revolving in lateral supports (616) and make the rocker a bridge type structure through which and under which passes at least one section of the drive slide (12) of a length substantially corresponding to the actuating stroke of the same, while the slider (8, 10, 11) associated with the linear actuator (3, 8) has a roller (111) for each lever (16) of the rocker and is movable between two end of stroke walls (9) which are transversal to the stroke of the drive slide (12), facing and distanced to each other in a measure corresponding to the stroke of the control rollers (111) for the disengagement of the drive slide (12) from the locking tooth (14).

22. Switch box according to claim 21, characterized by the fact that control tracks in shape of a cam (116) on the levers of the rocker (16) are provided on the lower end side of the same, while the rollers (111) connected to the slider (8, 10, 11) are revolving around horizontal and coaxial axis and supported on the vertical sides parallel to the actuating stroke of the same slider (8, 10, 11).

23. Switch box according to claim 22, characterized by the fact that the oscillating lever (16) is constantly spring loaded against the rollers (111) of the slider (8, 10, 11) by the elastic means (15) which press the locking tooth (14) against the drive slide (12), being of such dimensions as to project laterally outwards at least on one side, preferably on two sides from the walls of the drive slide (12) and pressing the rocker (16) onto said projecting section or sections of the tooth (14).

24. Switch box according to claim 19, characterized by the fact that the means for disengaging the drive slide (12) from the locking means in the positions of end of stroke of the drive are directly controlled by the means (3, 8, 9) coupling the drive slide (12) to a linear drive actuator (3, 8), during a stretch of the stroke wherein the means (8, 9) coupling to the linear actuator (3, 8) carry out a relative idle run with regards to the drive slide (12), before reaching the mechanical engagement of driving or pushing with the said drive slide (121, said means of coupling the linear actuators to the drive slide (12) being provided with control means (11, 111) of the oscillating lever (16), while the means to engage the locking tooth (14) in the corresponding notch (222) of the same drive slide (12) are constituted by the coupling means (8, 9, 1, 111), which during the terminal stretch of the actuating stroke move together with the same drive slide (12).

25. Switch box according to claim 20, characterized by the fact that the means coupling the drive slide (12) to the linear actuator are constituted by a slider (8, 10, 11) which can slide between two opposed end of stroke stops (103) distanced from each other in a measure corresponding to the idle run necessary to drive the oscillating lever (16) into the position of engagement and disengagement of the locking tooth (14) with one of the notches (212) in the drive slide (12) corresponding to the position of end of stroke of the same, the said slider (8, 10, 11) is dynamically connected to the linear actuator (3, 8) and has at least one roller (111) engaged with the track of the cam (116) profiled on the corresponding branch of the oscillating lever (16).

26. Switch box according to claim 22, characterized by the fact that the linear actuator is formed by a threaded rod (3) actuated revolving by a nut screw (8), the slider being constituted by the very nut screw (8) and a drive slide (11) of the same.

27. Switch box according to claim 20, characterized by the fact that position sensors (30, 31, 32, 35, 41, 42, 43) are provided for each blade (A1, A1', A2, A2'), the sensors (35, 40) sensing the two positions of end of stroke of the transmission rods (21) and position (37, 38) of the drive slide (12), said sensors being formed by limit switches (30, 36, 40).

28. Switch box according to claim 27, characterized by the fact that the position sensors for the blades (A1, A1', A2, A2') are foreseen on the side of rails (B1, B1', B2, B2') opposite to the associated blades (A1, A1', A2, A2'), and are controlled by a small rod (32, 41) which passes through the rails (B1, B1', B2, B2') and which acts directly or by means of mechanisms of transmission (43) on the pushbutton of the switch (30).

29. Switch box according to claim 27, characterized by the fact that the limit switches associated with the transmission rods (21) and the drive slide (12) are formed by sliders (37, 39) which are linked to the same through slots (36) in the corresponding walls of the box (1) and which act on the corresponding switches (38, 40), directly or by means of mechanisms of transmission (137, 138, 140, 240, 340, 440).

30. Switch box according to claim 29, characterized by the fact that the sliders (37) have surfaces to activate the pushbutton (138) of the switches (38) which are in shape of inclined lead-in surfaces (137).

31. Switch box according to the claim 30, characterized by the fact that the sliders are formed by a segment of a rack (39) which act on rollers with a side of the head provided with an outer set of teeth (140) and with the other opposite side of a head provided with an axial profile, or at least with one axial tooth (240), with lateral inclined lead-in surfaces, with which said rollers act on the pushbutton of the switches (40) one roller being foreseen for each limit switch (40).

32. Switch box according to claim 27, characterized by the fact that the position sensors at least of the transmission rods (21) and of the drive slide (12) are foreseen in one or more little boxes (35) arranged in the central area of the box between the two rails (B1, B1', B2, B2').

33. Switch box according to claim 19, characterized by the fact that the movable means (50) for rigidly connecting the transmission rods (21), or the central coupling rod (120) of the same to the drive slide (12), making the switch a non-kicker type.

34. Switch box according to claim 33, characterized by the fact that said means are formed by a pin (5) that can be inserted and removed manually.

35. Switch box according to claim 33, characterized by the fact that said means (50) for rigidly coupling the transmission rods (21) to the drive slide (12) are formed by at least one pin which cap be moved by means of actuators (51) alternatively into a position of active connection and into an inactive position of electromagnetical actuators.

36. Switch box according to claim 33, characterized by the fact that the means suitable to lock the transmission rods (21), or the central rod (12) on the drive slide (12) are of the type suitable for allowing a relative motion of a limited and preset amplitude (52) of the transmission rods and the central rod between each other.

37. Switch box according to claim 33, characterized by the fact that the pin (50) engages, in the two positions of closure of the blades respectively in a slot (52) elongated in direction of travel of the transmission rods (21) and applied in a central rod (120) connecting the same, the said slots (52) having a preset length.

38. Switch box according to claim 33, characterized by the fact that electromangetical (51) or mechanical (53,54) means are associated with the pin (50) for lifting or lowering the same in active or inactive position for locking the transmission rods (21) to the drive slide (12), respectively upon activation of said drive slide (12) and upon reaching the end of stroke position of the same.

39. Switch box according to claim 38, characterized by the fact that said means for lifting and lowering are mechanical means formed by cam tracks (54, 154) carried by the drive slide and integrally movable with the same and which engage with control rollers (53) on the free extremity of the pin (50).

40. Switch box according to claim 33, characterized by the fact that in conjunction with a switch of only two blades, each of the two blades being provided with movable locking means (24) in the position of closure with the associated rail.

41. Switch box according to claim 40, characterized by the fact that it is foreseen in conjunction with a switch with four or more blades (A1, A1', A2, A2') of an english type switch, in which the blades (A1, A1', A2, A2'), connect in pairs with rails (B1, B1', B2, B2') of a track and are activated together, a single drive slide (12) and a single rod-carrying saddle (18) being provided for all the four blades (A1, A1', A2, A2'), while, only outermost blades (A1, A2') are provided with movable locking means in the position of closure to an associated rail (B1, B2') and while inner blades (A1, A2') are locked in the position of closure thanks to a rigid link (55), for example a connecting rod with the outer blade (A1, A2') which takes up the position of closure together with the inner one (A2, A1').

42. Switch box according to claim 41, characterized by the fact that position sensors (30) of the innermost blades (A1', A2) are housed in the small central box (35) for the position sensors (38, 40) of the transmission rods (21) and the drive slide (12), or in a small dedicated central box.

* * * * *